US007128000B2

(12) United States Patent
Mummert

(10) Patent No.: US 7,128,000 B2
(45) Date of Patent: Oct. 31, 2006

(54) CATERING DISPLAY FOR FOOD

(76) Inventor: Nomi Mummert, 308 Summit Hall Rd., Gaithersburg, MD (US) 20877

( * ) Notice: Subject to any disclaimer, the term of this patent is extended or adjusted under 35 U.S.C. 154(b) by 292 days.

(21) Appl. No.: 10/732,225

(22) Filed: Dec. 11, 2003

(65) Prior Publication Data

US 2005/0126450 A1 Jun. 16, 2005

(51) Int. Cl.
*A47B 57/00* (2006.01)

(52) U.S. Cl. ..... 108/92; 108/90; 108/27

(58) Field of Classification Search ..... 108/92, 108/90, 27; 211/85.4, 128.1, 174, 85.2, 13.1, 211/85.15, 189; D7/389, 551.1; D26/95; 428/542.2, 542.4; 40/358, 800, 798, 799, 40/538; 52/103; 206/6.1; D6/449, 450, D6/474, 550; D11/131, 134, 164
See application file for complete search history.

(56) References Cited

U.S. PATENT DOCUMENTS

D31,817 S * 11/1899 Ray ..... D6/450
1,012,959 A * 12/1911 Zaharis ..... 108/92
1,704,365 A * 3/1929 McCauley ..... 211/128.1
1,713,908 A * 5/1929 Lane ..... 211/128.1
1,903,936 A * 4/1933 Nunnery ..... 211/69.5
1,925,673 A * 9/1933 Potter ..... 108/100
2,115,048 A * 4/1938 Stewart ..... 62/251
2,129,396 A * 9/1938 Archer ..... 312/234
2,697,294 A 12/1954 Zenker et al.
4,124,094 A * 11/1978 Cande ..... 182/187
4,530,863 A * 7/1985 Seeger ..... 428/13
4,960,308 A * 10/1990 Donaghy ..... 312/404
5,413,801 A * 5/1995 McIlwain ..... 426/420
5,456,956 A * 10/1995 Todd ..... 428/16
D382,513 S * 8/1997 Bozzone ..... D11/157
D392,208 S * 3/1998 Chong ..... D11/127
5,727,857 A 3/1998 Smith
5,813,497 A 9/1998 Iwamoto et al.
5,853,823 A * 12/1998 McKenna ..... 428/7
6,171,667 B1 * 1/2001 Kostic ..... 428/16
6,434,970 B1 8/2002 Hasegawa
6,533,120 B1 3/2003 Csengeri
6,543,905 B1 * 4/2003 Adams et al. ..... 362/122
6,655,056 B1 * 12/2003 Wolf et al. ..... 40/124
6,935,070 B1 * 8/2005 Ramirez ..... 47/41.01

FOREIGN PATENT DOCUMENTS

JP 2000-189299 7/2000

* cited by examiner

*Primary Examiner*—Peter M. Cuomo
*Assistant Examiner*—Noah Chandler Hawk
(74) *Attorney, Agent, or Firm*—Richard C. Litman

(57) ABSTRACT

The catering display provides an attractive serving setting for sushi and other foods, increasing the visual appeal of the foods. A stepped base provides multiple surface levels so that sushi and other foods can be well displayed, having pieces toward the center of the base elevated rather than hidden by pieces in front. A hollow interior of the stepped base receives an ice tray so that the entire display base can be kept chilled. The chilled base tends to keep the food items fresh for a longer period of time. Ornamental attachments may be secured to the stepped base, to create a more aesthetically pleasing display of sushi or other food items. For example, a miniature "torii gate", reminiscent of the ancient temples of Japan, may be mounted atop the stepped base. The "torii gate" may be removed, and replaced with other ornamental attachments.

5 Claims, 13 Drawing Sheets

CATERING DISPLAY FOR FOOD

BACKGROUND OF THE INVENTION

1. Field of the Invention

The present invention relates to serving pieces for catering, and more specifically to a catering display for sushi and other foods.

2. Description of the Related Art

In Japanese cuisine, sushi is a food with over a thousand years of history and tradition. The styles of sushi most familiar to western diners evolved in Japan in the eighteenth century. Like many Japanese traditions, sushi is often considered a form of art.

Sushi, either "Nigiri-zushi" in the form of a small portion of rice topped with a piece of raw or cooked fish, or "Maki-zushi" in the form of strips of raw fish rolled in rice and wrapped in a thin sheet of dried seaweed, is served in small pieces that are presented to enhance the natural beauty of the simple ingredients. The beauty of presentation is second only to the quality and freshness of the ingredients in sushi tradition.

Beautiful presentation of sushi is often achieved, on a small scale for individual serving, by using simple and decorative plates or platters whereon a single serving of sushi can be attractively arranged and embellished with condiments for a single diner. However, when large amounts of sushi must be presented for a large number of individuals, such as in a buffet, or at a catered event, the desire for beautiful presentation must be pitted against the need to keep the large quantities of sushi fresh, both for health reasons and to ensure that the sushi pieces remain at their highest quality.

Various methods and apparatus for serving sushi have been devised. U.S. Pat. No. 5,813,497, issued on Sep. 29, 1998 to Y. Iwamoto et al., discloses a method and apparatus for serving and displaying food wherein a continuous watercourse runs around the periphery of a counter or sushi bar, with patrons seated along the continuous watercourse. Food carriers, configured as miniature boats navigating the watercourse, carry trays of sushi for the patrons to select as the miniature boats go by. This method and apparatus illustrates the lengths that a sushi restaurant might go to in order to offer a unique, and aesthetically pleasing presentation. However, such a method and apparatus is clearly inappropriate for a portable food service, as is often required in the food catering industry.

U.S. Pat. No. 6,434,970, issued on Aug. 20, 2002 to H. Hasegawa, discloses a plate, mainly used for serving sushi on a revolving conveyor in restaurants. The plate is provided with a central recess with an ice disk set inside, and covered with a transparent cover, so that the interior of the plate is kept cool in order to keep the sushi fresh and the sushi is protected from contact with the outside air. While the plate serves to keep a small serving of sushi fresh, it is not ideally suited to serve a large amount of sushi, as at a buffet or a catered event. Although the cover is desirable for such small servings, a covered serving plate might be a hindrance to a large number of people serving themselves from a large display of food. Additionally, the plate is discussed on conjunction with a conveyor system that is not suitable for a portable food service, as is often required in the food catering industry.

U.S. Pat. No. 6,533,120, issued on Mar. 18, 2003 to P. Csengeri, discloses an apparatus with multiple-level eating surfaces, which can be made as separable modular units, or molded units having a one-piece construction.

Japanese Patent No. 2000-189,299, published in July 2000, discloses a display stand for conically rolled sushi. The display stand includes a platform having several holes of varying size. The conically rolled sushi pieces sit lower in larger holes, and higher in smaller holes, thereby displaying the sushi pieces at varying heights.

U.S. Pat. No. 5,727,857, issued on Mar. 17, 1998 to L. Smith, discloses a portable knockdown food display apparatus. The apparatus includes a rack for holding food, and a container for containing ice. During use, the container is partially filled with ice, and the rack is placed into the container in close proximity to the ice. The apparatus includes legs and a cover. The apparatus can be broken down for portability.

U.S. Pat. No. 2,697,294, issued on Dec. 21, 1954 to J. Zenker et al., discloses a pastry dummy, the pastry dummy being a circular, multi-tiered mock cake form to which icing, frosting, or simulated frostings may be applied to provide imitation cakes and the like for display purposes.

None of the above inventions and patents, taken either singly or in combination, is seen to describe the instant invention as claimed. Thus a catering display for food solving the aforementioned problems is desired.

SUMMARY OF THE INVENTION

The catering display for food provides an attractive display for sushi and for other foods. A stepped base provides multiple surface levels so that small food items, such as sushi pieces, can be well displayed, having pieces toward the center of the base elevated rather than hidden by pieces in front.

The stepped base has a hollow interior for receiving an ice tray, so that the entire display base can be kept chilled. The chilled base tends to keep the food pieces fresh for a longer period of time.

Ornamental attachments may be secured to the stepped base, to create a more aesthetically pleasing display of sushi or other food items. For example, a miniature "torii gate", reminiscent of the ancient temples of Japan, may stand atop the stepped base, creating an image that reflects Japanese history and tradition. The "torii gate" may be removed, and replaced with other ornamental attachments that fit the many, varied themes of a catered event.

The catering display for food is portable, due to its size and collapsible nature. Because the ornamental attachments are removable, and because the catering display for food is kept chilled by ice without the requirement for refrigeration equipment, the catering display for food may be readily transported to, and set up at, a variety of sites to suit numerous different occasions. Thus, the catering display for food is well adapted for the catering industry, and is well suited to a catered display and presentation of sushi.

Although well adapted for the display and presentation of sushi, the catering display of the present invention can also be used to provide a serviceable and aesthetically pleasing display stand for other types of catered foods.

Accordingly, it is a principal object of the invention to provide a catering display for food.

It is another object of the invention to provide a catering display for food that is attractive as well as functional.

It is a further object of the invention to provide a catering display for food that can be ornamentally reconfigured.

Still another object of the invention is to provide a catering display for food that can be chilled to keep sushi fresh.

Yet another object of the invention is to provide a catering display for food that is easily transportable.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
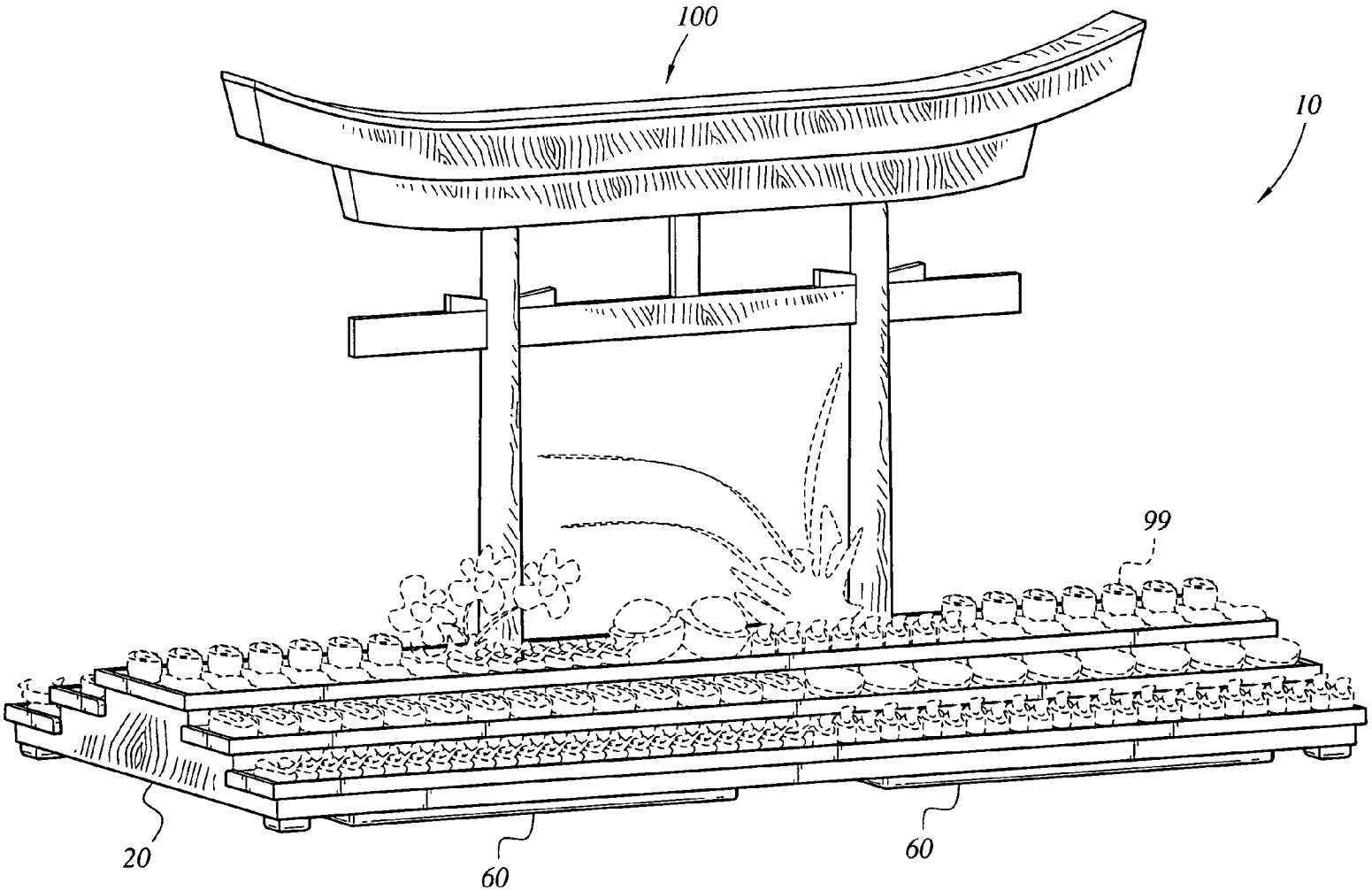
FIG. 1 is an environmental, perspective view of a catering display for food according to the present invention.

The present invention is a catering display for food, designated generally as 10 in the drawings. Referring to FIG. 1, the catering display for food 10 comprises a stepped base platform 20 for displaying and serving sushi pieces 99 or other food items, such as fruit, cheese, candy pieces and other items. The base platform 20 is a generally rectangular platform having steps, or tiers, running lengthwise. Sushi pieces 99 are displayed on the base platform 20 on the different steps, or tiers, so that the rows of sushi pieces 99 toward the center of the base platform 20 are not obscured by rows of sushi pieces 99 towards the sides of the base platform 20. This allows each of the sushi pieces 99 to be more optimally displayed than on a simple, planar surface. A hollow interior of the base platform 20 accommodates one or more ice trays 60 in order to keep the base platform 20 chilled, ensuring that the sushi pieces 99 remain fresh. The base platform 20 supports a decorative fixture, such as the miniature "torii gate" 100 illustrated.

Figure 2:
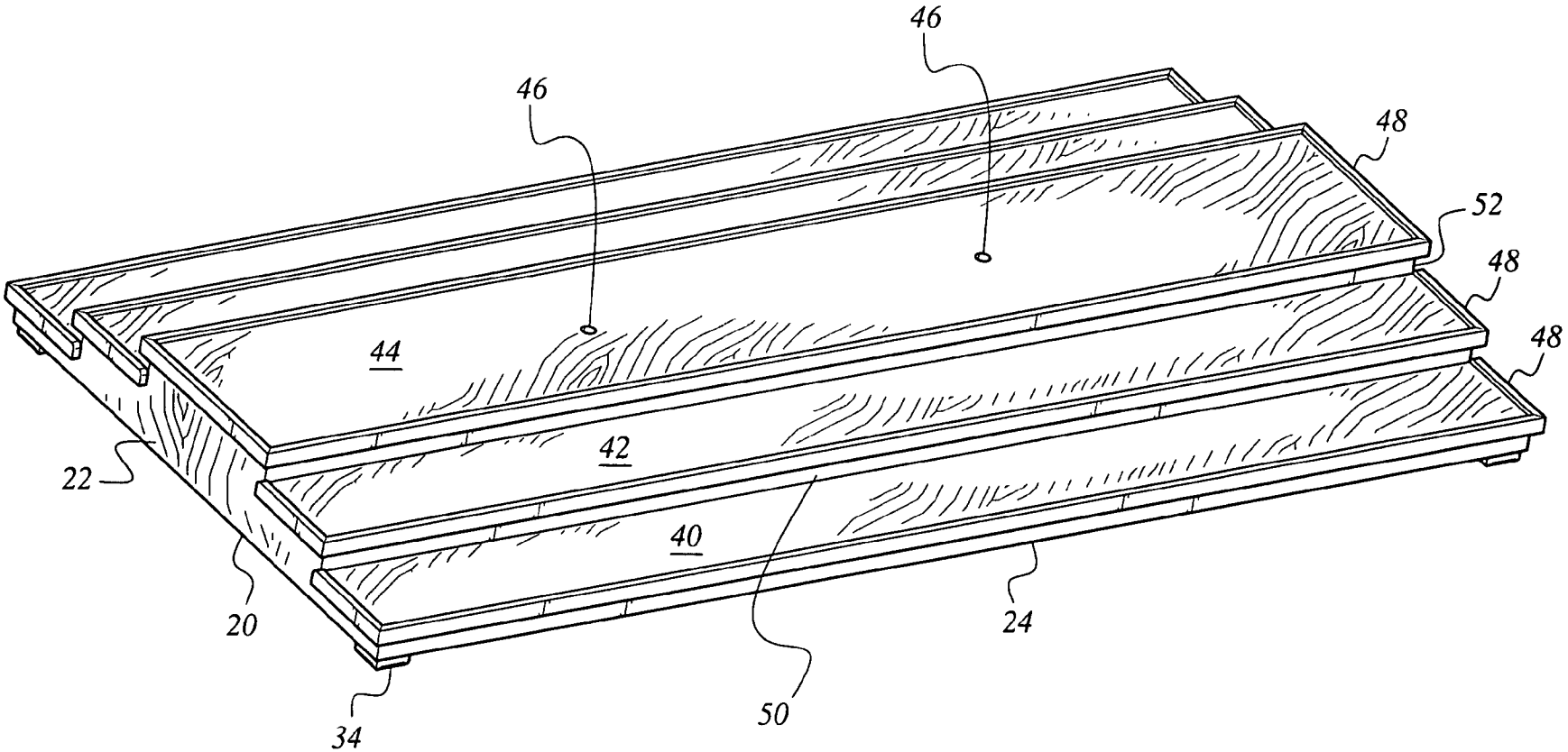
FIG. 2 is a perspective view of a base platform of a catering display for food according to the present invention.
Figure 3:
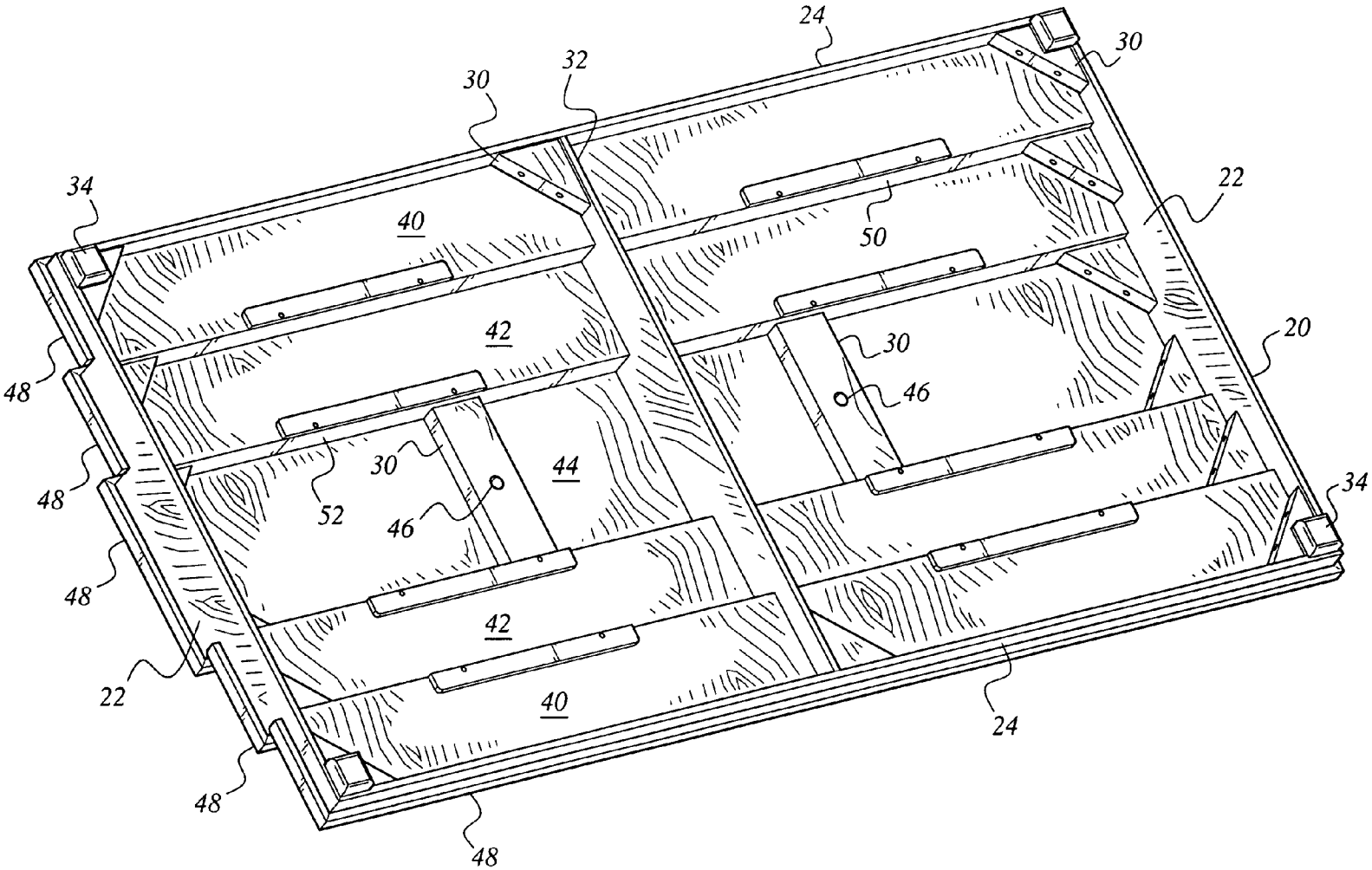
FIG. 3 is a bottom perspective view of a base platform of a catering display for food according to the present invention.

Turning now to FIGS. 2 and 3, the base platform 20 comprises a rectangular frame formed by a pair of stepped end pieces 22, joined to a pair of elongated, rectangular sides 24, the sides 24 being longer than the stepped end pieces 22. The stepped end pieces 22 define a plurality of step levels. A plurality of steps extend between the stepped end pieces 22, to form the tiers of the base platform 20.

In the embodiment illustrated, the base platform 20 has three step levels. A top step 44 extends lengthwise across the base frame between the stepped end pieces 22, centered between the sides 24. A pair of middle steps 42 extend lengthwise across the base frame between the stepped end pieces 22, a middle step 42 being on each side of the top step 44. An upper riser 52 extends lengthwise between the stepped end pieces 22, filling in the space between the back edge of each middle step 42 and the top step 44 above. A pair of bottom steps 40 extend lengthwise across the base frame between the stepped end pieces 22, a bottom step 40 being between each middle step 42 and a side 24 of the base platform 20. A middle riser 50 extends lengthwise between the stepped end pieces 22, filling in the space between the back edge of each bottom step 40 and the middle step 42 above. A raised edge 48 surrounds each of the steps 40, 42, and 44, and functions to retain a protective glass or Plexiglas sheet that may be placed on each of the steps.

Apertures 46 are defined in the top step 46. Referring to FIG. 3, support blocks 30 are shown reinforcing the underside of the top step 44 in the area of the apertures 46, with apertures 46 continuing through the support blocks 30. The reinforced apertures 46 thus provide a receptacle for mounting a decorative fixture, such as the miniature "torii gate" 100. The platform base 20 is structurally reinforced by additional support blocks 30 or gussets forming corner braces, and by a stepped center support 32 that provides additional support for the steps. The platform base 20 itself is supported by feet 34, affixed to the bottom of each corner of the platform base 20. The platform base is preferably structured of wood, and preferably finished with a clear or colored hard lacquer.

Figure 4:
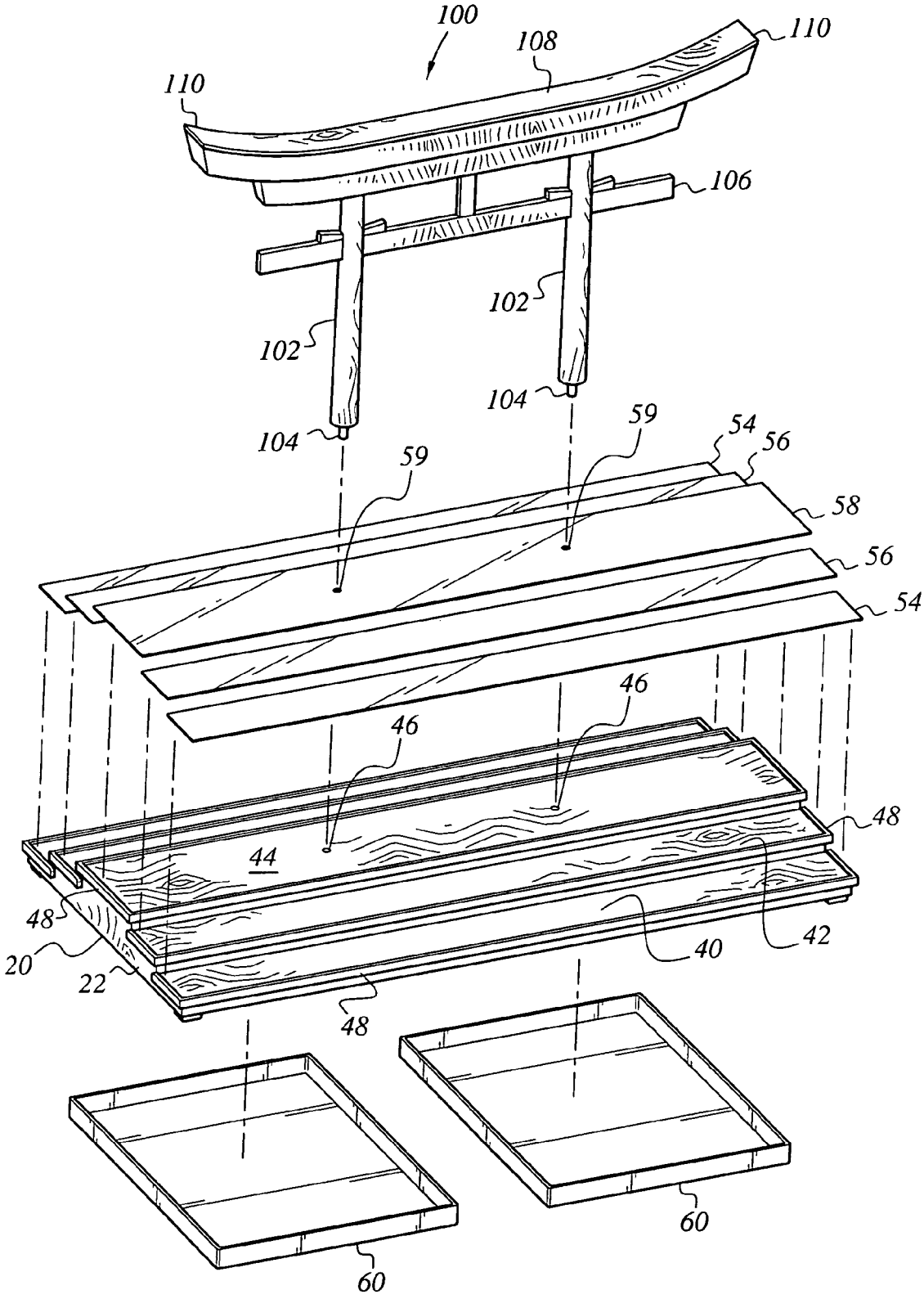
FIG. 4 is an exploded, perspective view of a catering display for food according to the present invention.

Referring now to FIG. 4, the catering display for food 10 is set up for use by placing the platform base 20 over one or more ice trays 60, filled with ice (not shown) to chill the platform base 20. Ice trays 60 are fitted to the interior of the platform base 20. A protective glass or Plexiglas sheet overlays each of the steps. A top protective sheet 58, overlaying the top step 44, has apertures 59 in alignment with the apertures 46 of the top step so that an ornamental fixture, such as the miniature torii gate 100, can be mounted to the platform base 20 through the top protective sheet 58. Middle protective sheets 56 overlay the middle steps 42, and bottom protective sheets 54 overlay the bottom steps 40. The protective sheets are held in place by the raised edges 48 surrounding each step.

The miniature torii gate 100 shown in FIG. 4 is an example of an ornamental fixture that may be mounted to the platform base to enhance the aesthetic appeal of the catering display for food 10, and of food items presented thereon. The miniature torii gate 100 comprises a pair of tapered upright posts 102. Each of the posts 102 has a short mounting peg 104 extending from the bottom end of the post 102. The mounting pegs 104 are adapted to fit securely into apertures 46 in the platform base 20 to support the torii gate 100. A lower timber 106 extends between posts 102, and extends through each post 102 near the top of the posts. An upper timber 108 rests on top of the posts 102, with ends 110 of the upper timber 108 extending beyond the posts. The ends 110 of the timber 108 are swept skyward.

Figure 5:
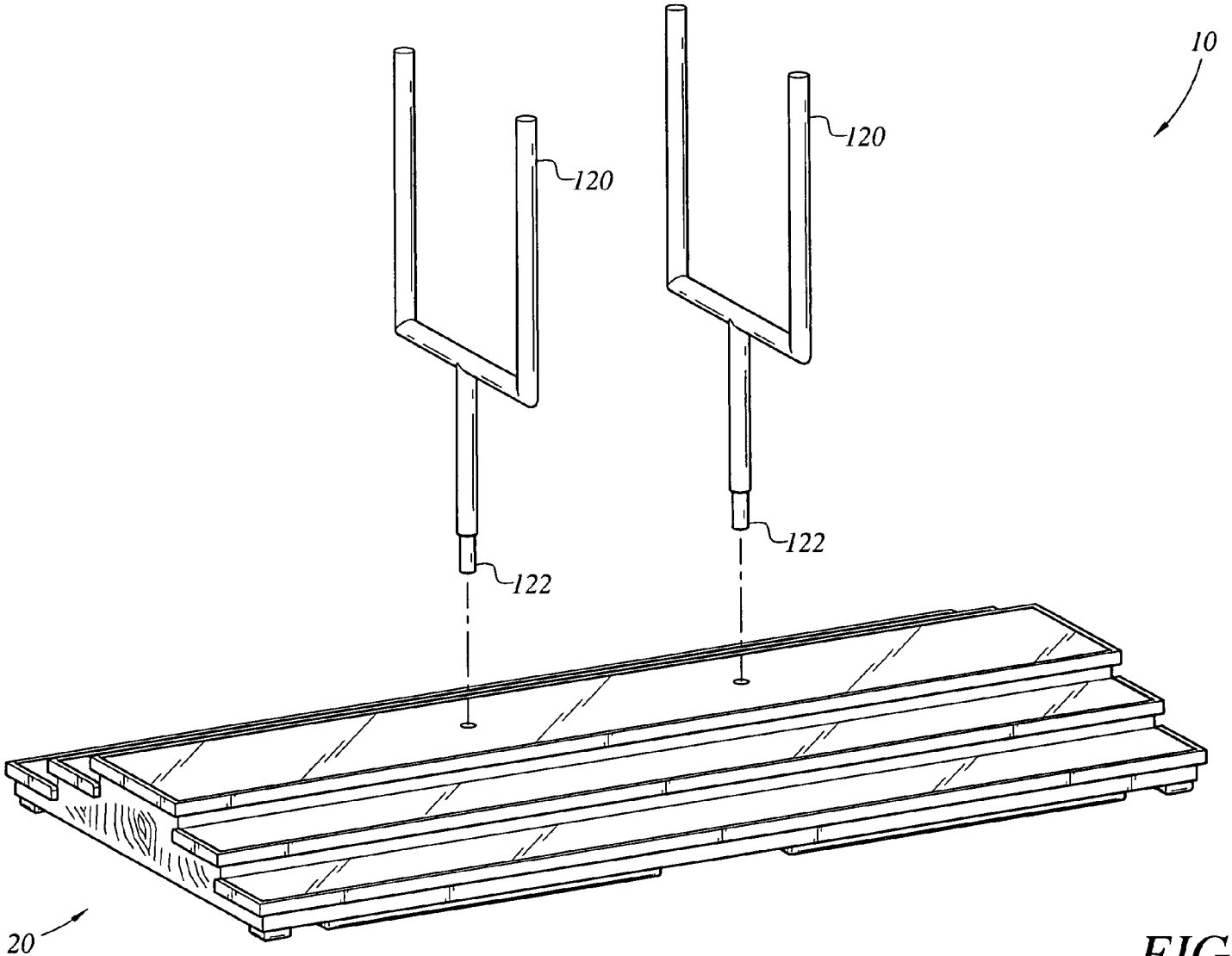
FIG. 5 is an exploded, perspective view of a catering display for food according to the present invention illustrating a first alternative ornamental fixture for the catering display for food.
Figure 6:
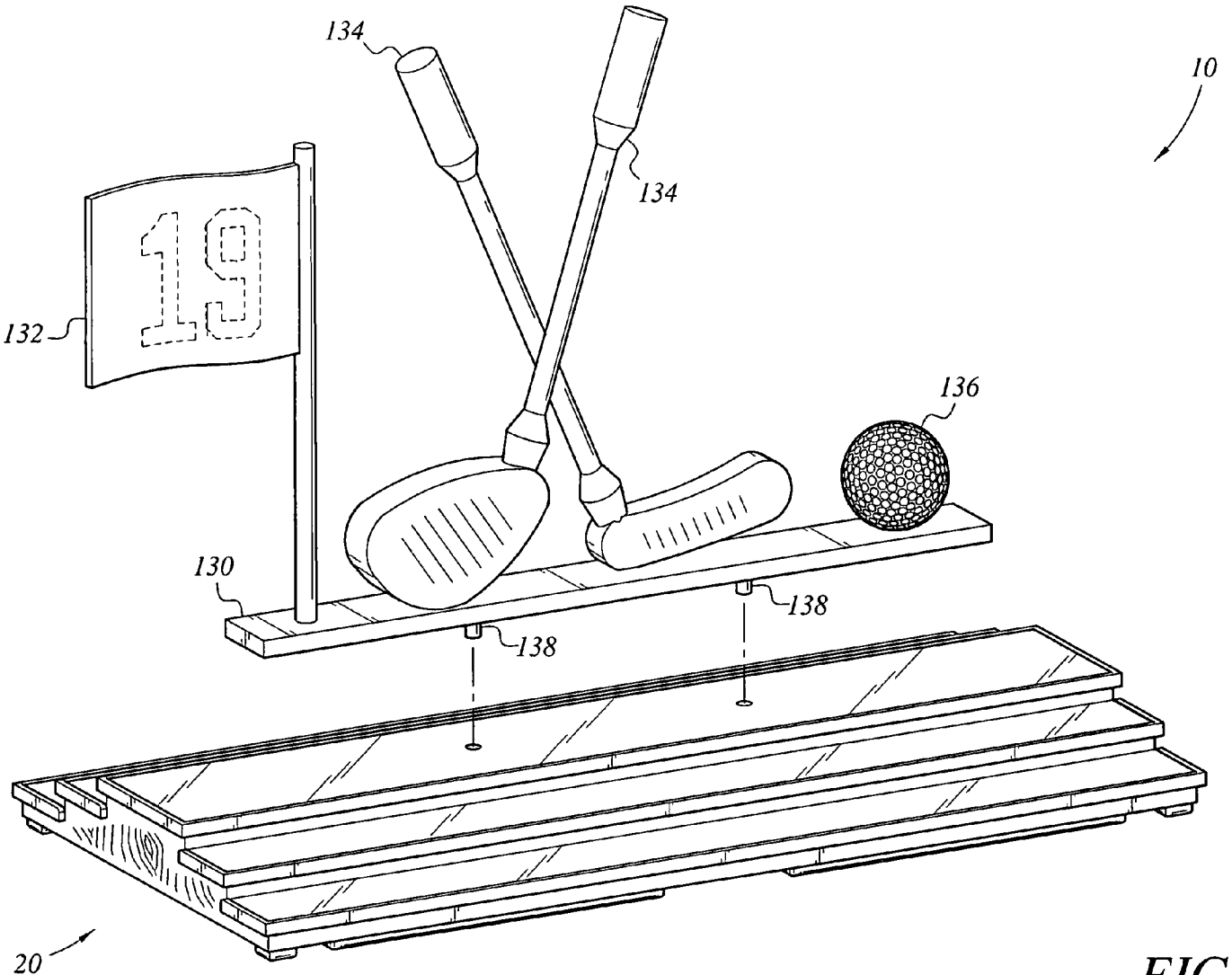
FIG. 6 is an exploded, perspective view of a catering display for food according to the present invention illustrating a second alternative ornamental fixture for the catering display for food.
Figure 7:
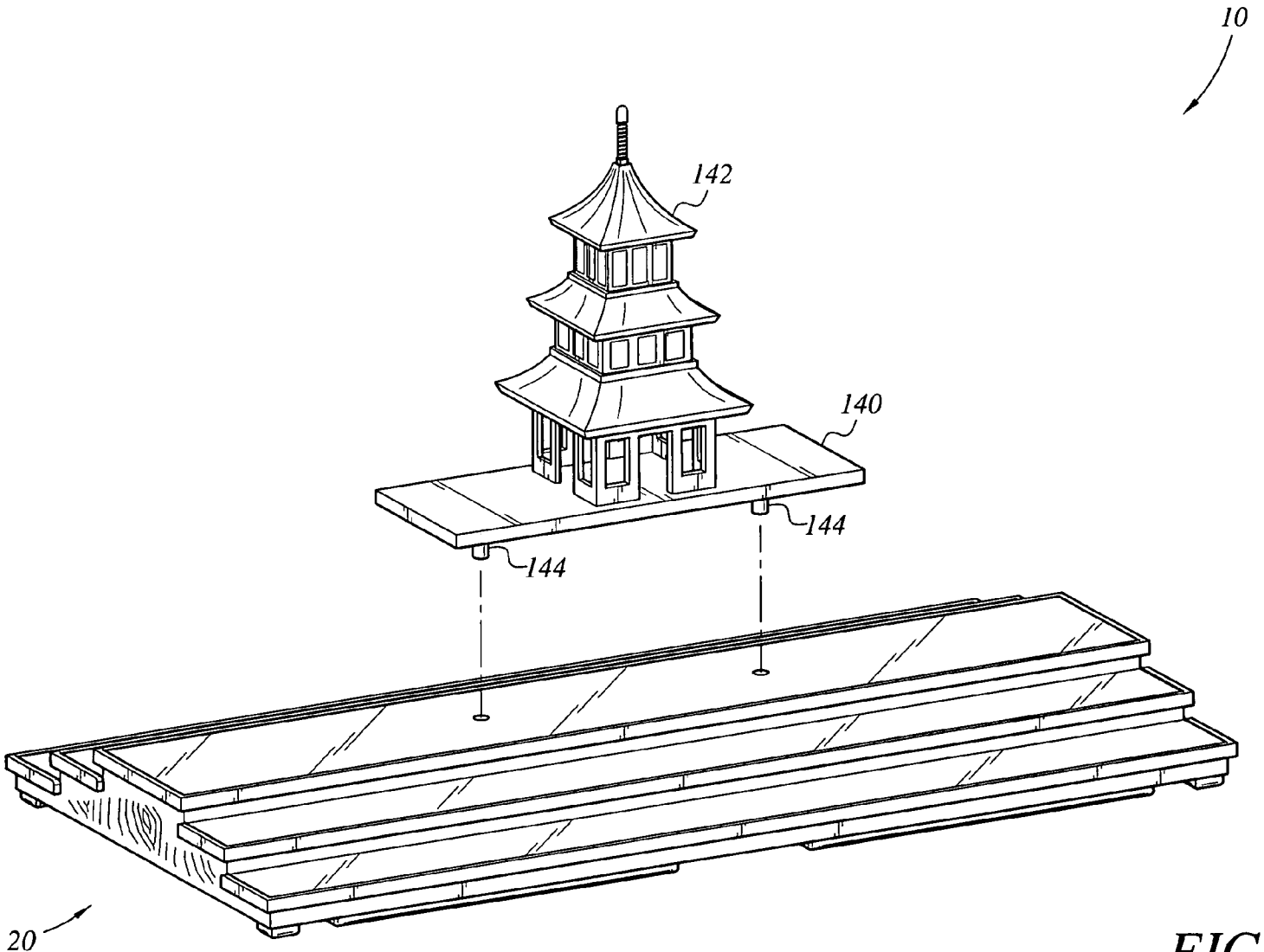
FIG. 7 is an exploded, perspective view of a catering display for food according to the present invention illustrating a third alternative ornamental fixture for the catering display for food.

Additional examples of ornamental fixtures are shown in FIGS. 5–7. In FIG. 5, a pair of football goal posts 120 are affixed to the platform base 20 by mounting pegs 122, the mounting pegs 122 extending from the bottom of the goal posts 120.

Turning to FIG. 6, an ornamental fixture is shown wherein several ornamental figures are mounted on a fixture base 130. Mounting pegs 138 extend from the bottom of the fixture base 130 and support the fixture base 130, and the ornamental figures mounted to the fixture base 130, on the platform base 20. Ornamental figures might include, for example, golf related figures such as a flag 132, golf clubs 134, and a golf ball 136.

Referring now to FIG. 7, a miniature temple 142 is shown as an ornamental figure. The miniature temple is mounted on a fixture base 140, with mounting pegs 144 extending from the fixture base 140 to mount the ornamental fixture to the platform base 20.

Figure 8:
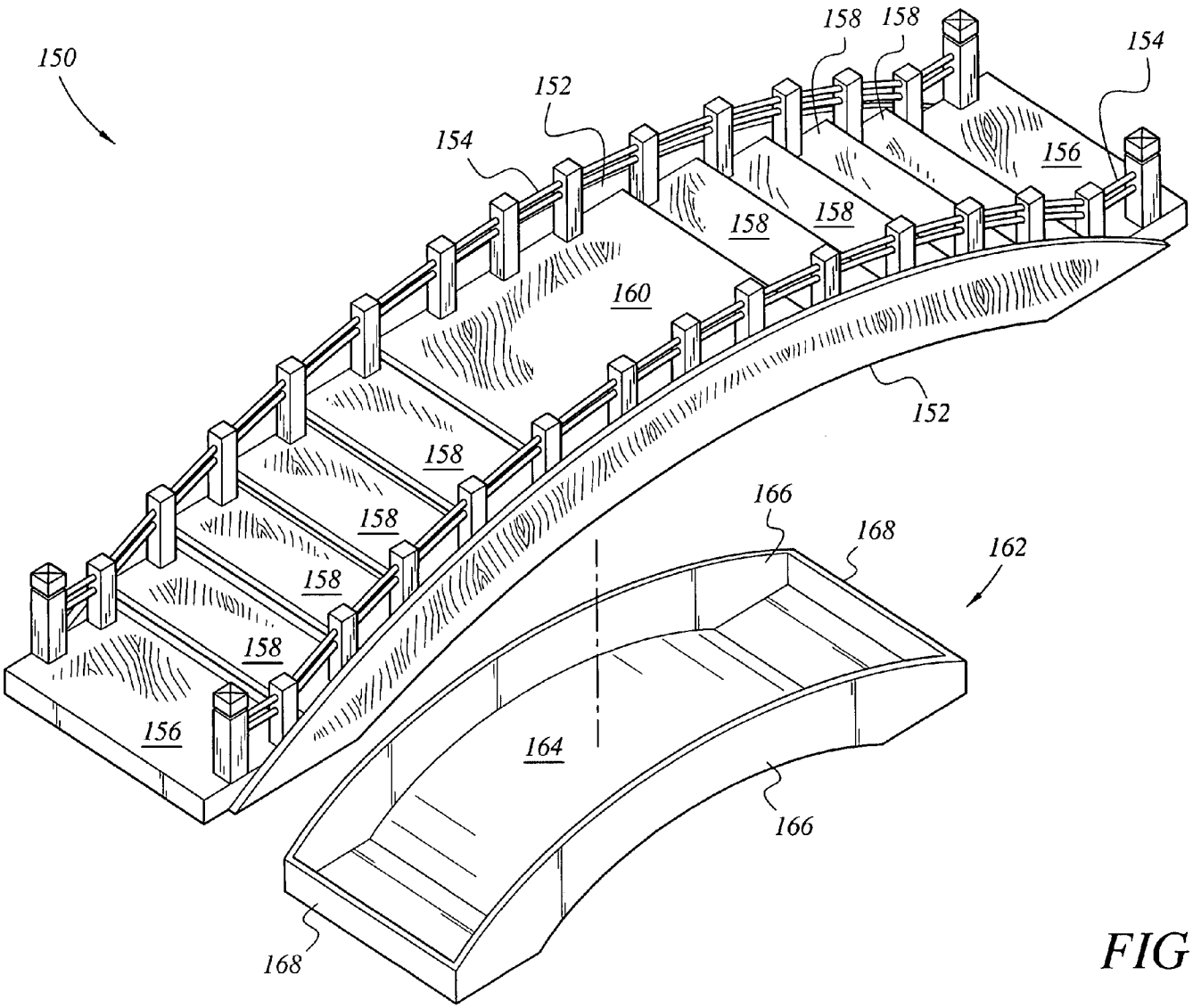
FIG. 8 is an exploded, perspective view of an embodiment wherein the catering display for food is configured to resemble a bridge.

In an alternate embodiment, shown in FIG. 8, a catering display for food 150 is configured to resemble a miniature bridge. In this embodiment of the catering display for food 150, stepped end pieces 152 are elongated and arched, and in this embodiment serve as sides of the bridge. Bottom steps 156 replace the rectangular sides 24 seen in the previous embodiment, a bottom step 156 being disposed between the stepped end pieces 152 at each end of the stepped end pieces. A top step 160 is supported between the stepped sides 152, about mid-span of the bridge. Several intermediate steps 158 are disposed along the span of the bridge between the top step 160 and the bottom steps 156 in a stair-step arrangement, supported between the stepped end pieces 152.

An ice tray 162 may be used with the catering display for food 150, disposed within the hollow underside of the bridge. Used with the ice tray 162, the catering display for food 150 is kept chilled to prolong the freshness of items displayed on the catering display for food 150. The ice tray 162 is an arched pan having an arched bottom 164, arched side walls 166 attached along each side of the arched bottom 164, and end walls 168 attached at the ends of the arched bottom 164. Because the ice tray 162 is retained within the hollow interior of the bridge, the catering display for food 150 may be kept chilled without the external appearance of ice, an ice tray, or another cooling device.

Figure 9A:
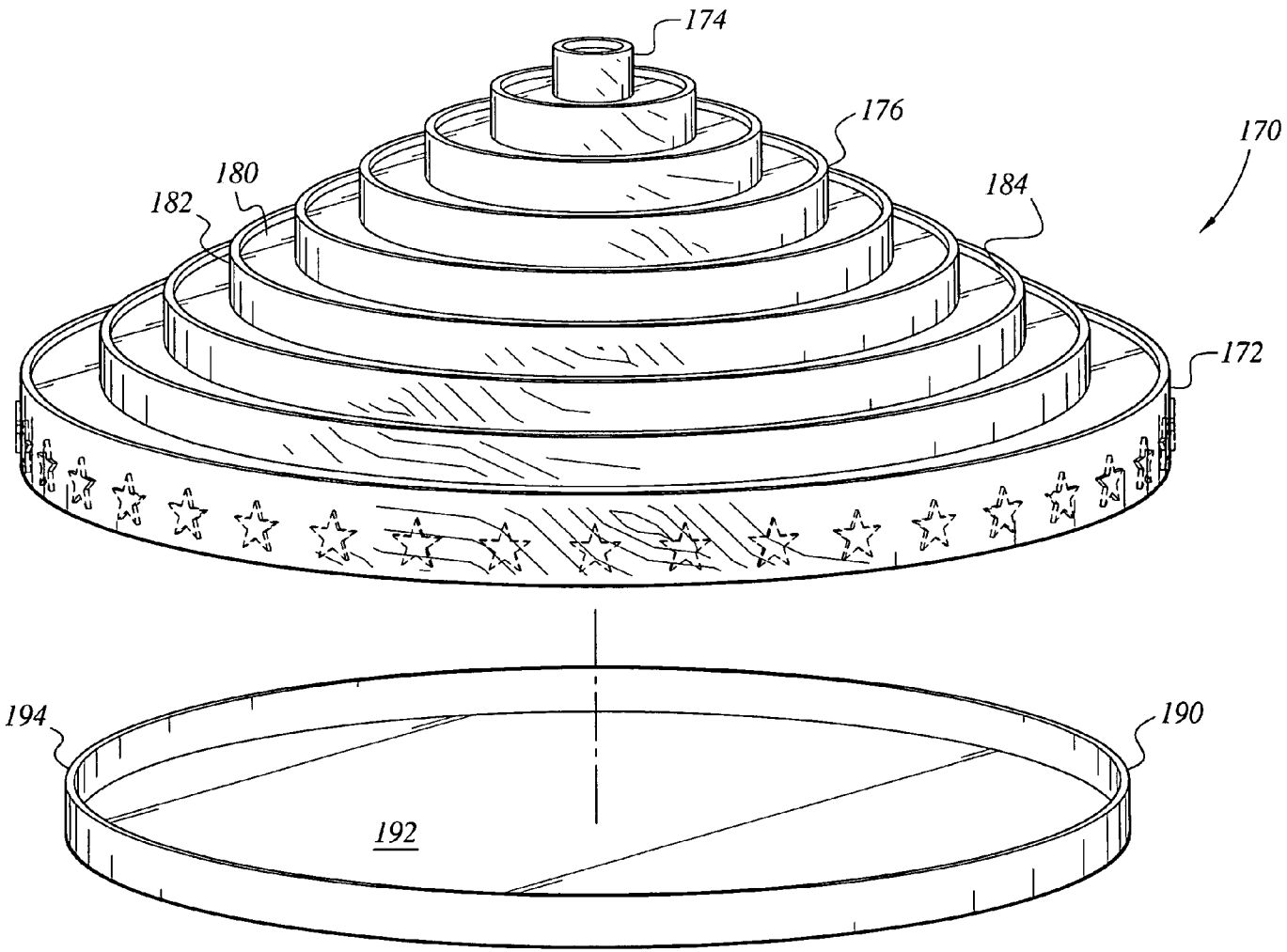
FIG. 9A is a perspective view of another embodiment of a catering display for food according to the present invention.
Figure 9B:
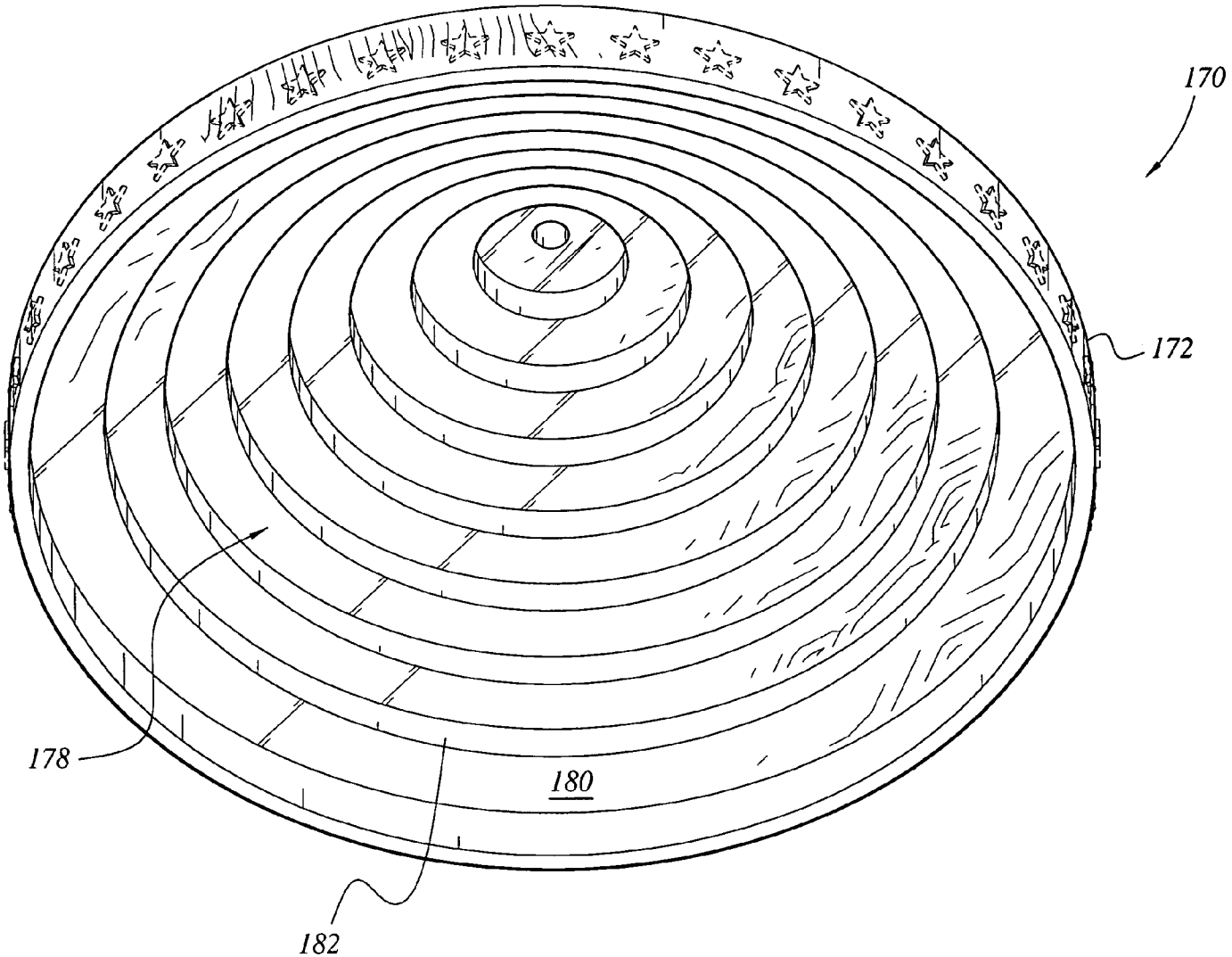
FIG. 9B is a bottom perspective view of the catering display for food illustrated in FIG. 9A.
Figure 9C:
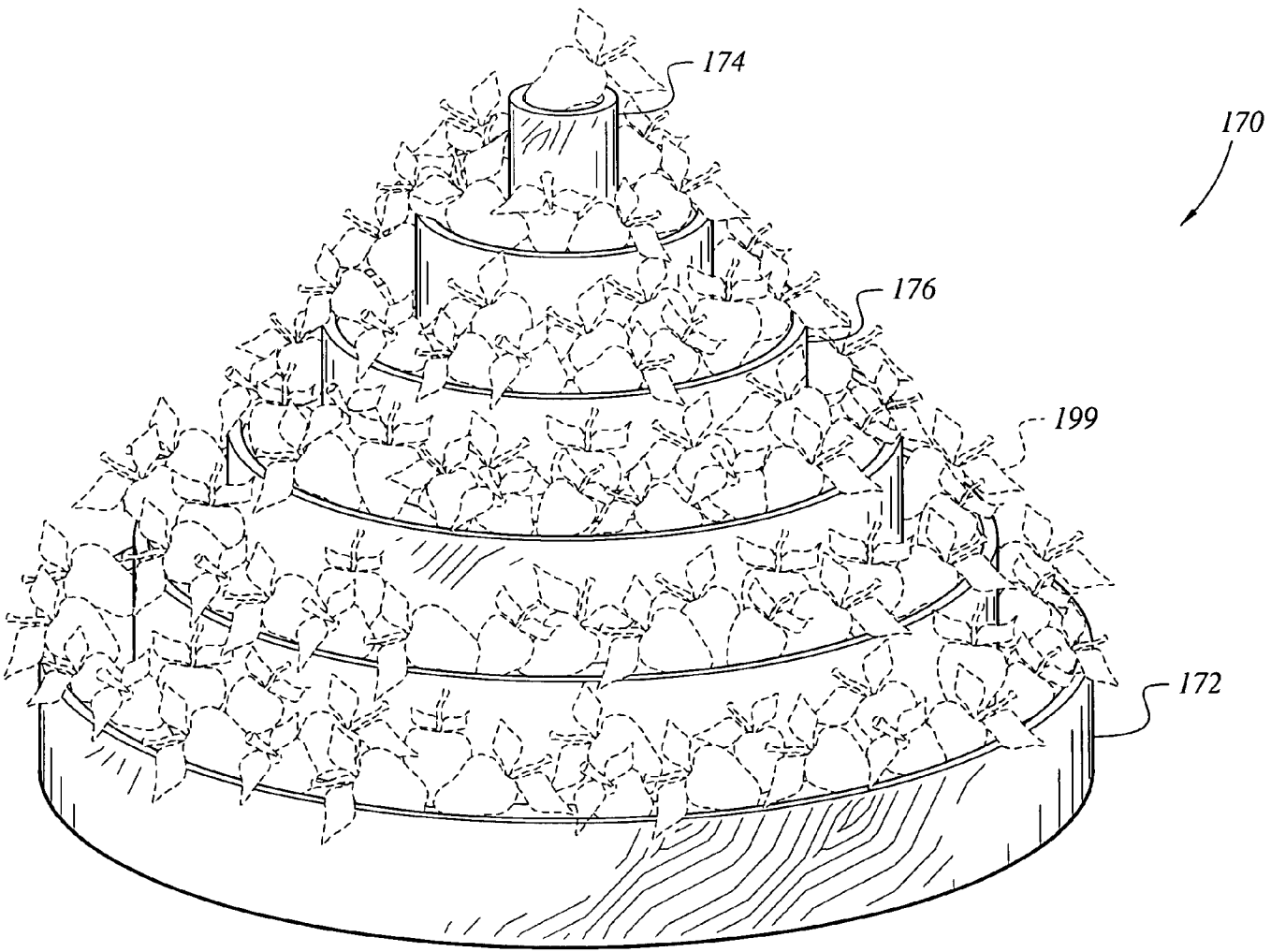
FIG. 9C is an environmental, perspective view of the catering display for food illustrated in FIG. 9A.

FIGS. 9A–9C show another embodiment of a catering display for food 170, wherein the catering display for food 170 is in the form of a circular, multi-tiered tray. The catering display for food 170 of this embodiment has a bottom tier 172, a top tier 174, and at least one intermediate tier 176. Each of the bottom tier 172 and the intermediate tiers 176 have a perimeter wall 182 and a tier surface 180 forming a tier of the catering display for food 170. Preferably, for each tier, the perimeter wall 182 extends above the tier surface 180 to form a raised edge 184 around the perimeter of the tier. The raised edge 184 provides additional support for food items placed on the catering display for food 170, helping to prevent the food items from falling.

The tiers of the catering display for food 170 are arranged with intermediate tiers 176 stacked above the bottom tier 172, each intermediate tier 176 having a radius smaller than the tier below it. The top tier 174 sits atop the uppermost of the intermediate tiers 176.

Referring to FIGS. 9A and 9B, it can be seen that the catering display for food 170 is formed with a hollow interior 178. An ice tray 190 fits within the hollow interior 178 of the catering display for food 170. The ice tray 190 is a circular tray having a circular bottom 192, and a circular perimeter wall 194 forming a tray for receiving and holding a quantity of ice.

The number of tiers and the height of the catering display for food 170 can be varied for different food presentation and decoration, ranging from a relatively low display to a tall display that could be decorated with food items to resemble a Christmas tree. FIG. 9C shows the catering display for food 170 decorated with strawberries 199 covering the catering display for food 170 to create a beautiful and eye-pleasing display of red and green.

Figure 10:
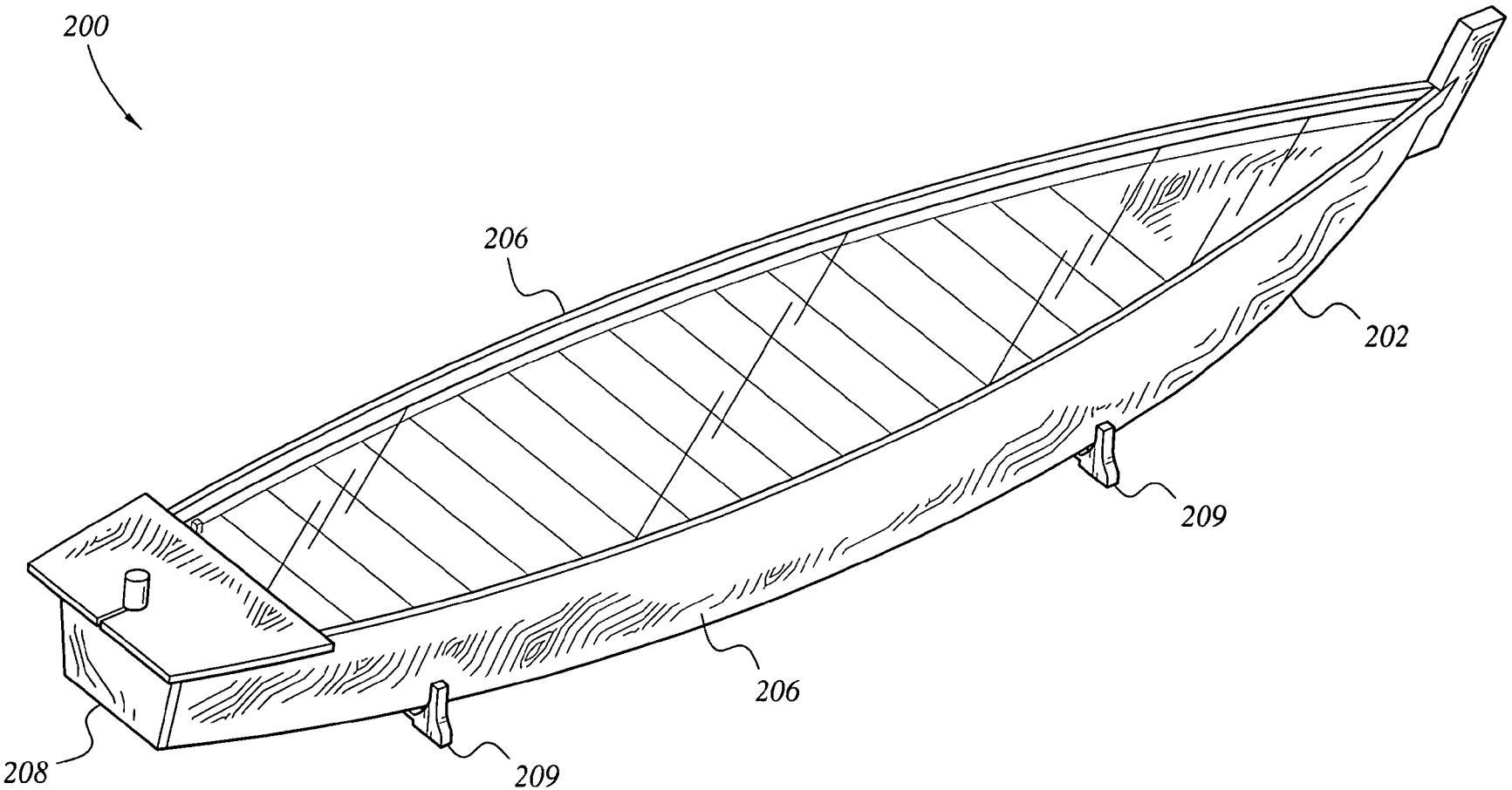
FIG. 10 is a perspective view of an alternate embodiment of a catering display for food.
Figure 11:
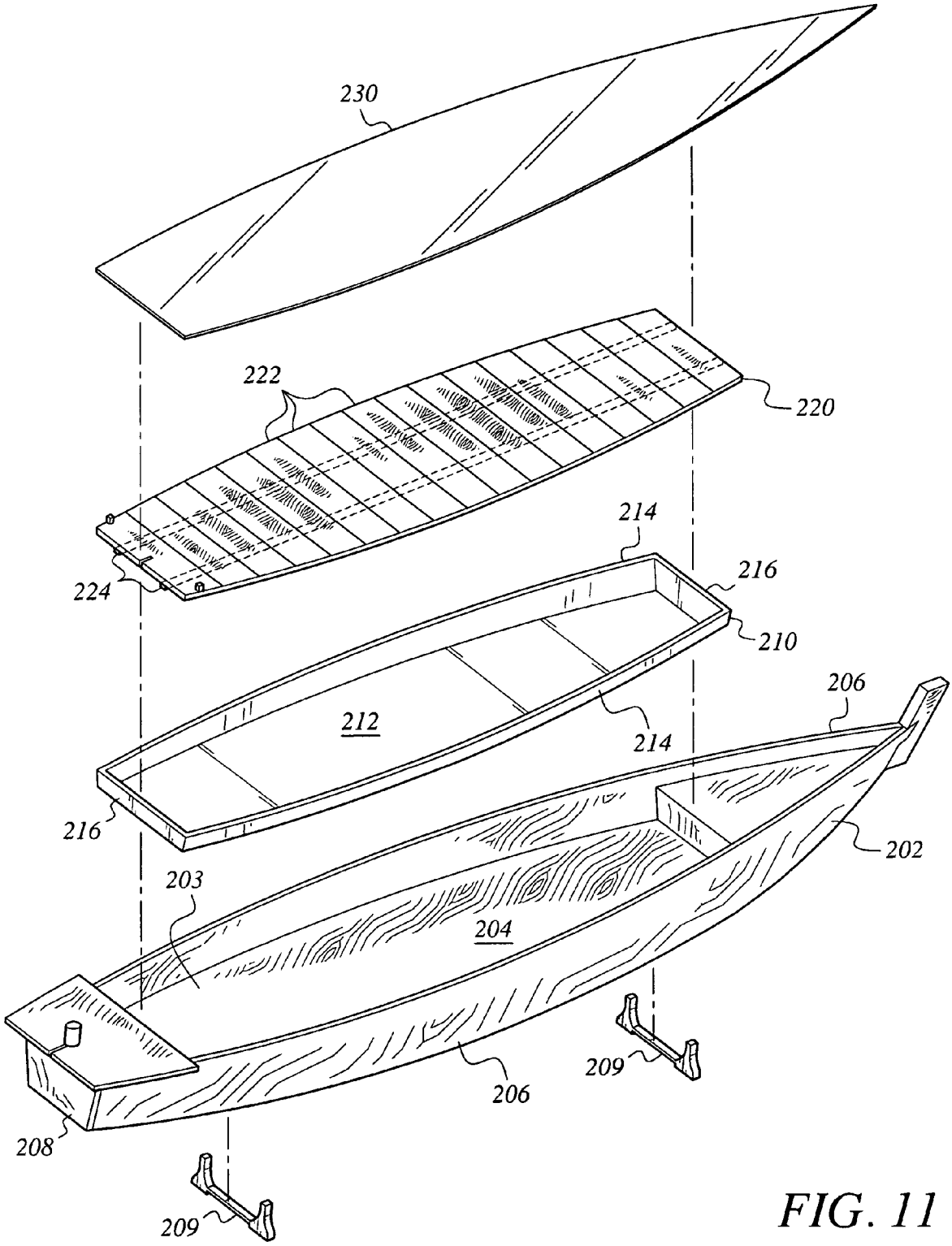
FIG. 11 is an exploded view of the catering display for food illustrated in FIG. 10.

Turning now to FIGS. 10 and 11, another embodiment of a catering display for food 200 is shown. The catering display for food 200 is a serving platform, fashioned in a decorative shape, which is adapted to conceal an ice tray within its interior.

The catering display for food 200 of this embodiment has a decorative shape that is generally reminiscent of a boat, having a platform base that is configured to resemble a boat hull 202. The boat hull 202 is basically a low-walled open container having a floor 204 with "bow" and "stern" ends, an end wall 208 located at the "stern" end, and side walls 206 that join together at the "bow" end of the boat hull 202. The boat hull 202 is thus formed with a hollow interior 203. An ice tray 210 fits inside the hollow interior 203 of the boat hull 202. The ice tray has a generally flat bottom 212, enclosed by sidewalls 214 and end walls 216 to form a tray configured to fit within the hollow interior 203 of the boat hull 202.

A slatted platform 220 covers the ice tray 210 within the hollow interior 203 of the boat hull 202, largely concealing the ice and ice tray 210 below. The slatted platform 220 comprises a plurality of slats 222, supported by a pair of parallel longitudinal stringers 224.

A protective sheet 230 formed of glass or Plexiglas overlays the slatted platform 220 within the hollow interior 203 of the boat hull 202. The protective sheet 230 provides a food-serving surface that is readily removable from the catering display for food 200 for cleaning.

A pair of legs 209 are removably attached to the bottom of the boat hull 202. The legs 209 may be used singly, or together, to vary the positioning of the catering display for food 200 to create different arrangements of the catering display for food 200 on a table, as well as different arrangements of food on the catering display for food 200.

It is to be understood that the present invention is not limited to the embodiments described above, but encompasses any and all embodiments within the scope of the following claims.

I claim:

1. A catering display, comprising:

a rectangular base having a pair of stepped ends and a pair of elongated rectangular sides, the stepped ends defining a plurality of step levels including at least a top step level and a bottom step level;

a plurality of steps disposed on said rectangular base, the steps extending between said stepped ends, each of the steps being coincident with one of said step levels, each of said steps having a top surface and a bottom surface, one of the steps being a top step coincident with said top step level, there being at least two apertures defined in and extending through the top step;

wherein said rectangular base and said steps define a base platform having a stepped top surface and a hollow interior;

at least a pair of reinforcing blocks disposed beneath and engaging the bottom surface of said top step, each reinforcing block of said pair having an aperture extending therethrough and in alignment with one of said at least two apertures extending through said top step;

a plurality of transparent protective sheets, one of said plurality of protective sheets removably disposed on and covering the top surface of each of said plurality of steps with the protective sheet removably disposed on said top surface of said top step having at least two apertures therethrough that are in alignment with the at least two apertures in said top step;

each of said plurality of steps including a raised edge surrounding the top surface thereof, said raised edges retaining said transparent protective sheets on said steps;

at least one tray for containing ice, said at least one tray being configured to fit within said hollow interior of said base platform; and an ornamental fixture disposed on said top step and engaging said at least two apertures thereof.

2. The catering display according to claim 1, wherein said top step is centered between the sides of said rectangular base.

3. The catering display according to claim 1, wherein said ornamental fixture comprises:

a pair of vertical posts having top and bottom ends;

a mounting peg extending from the bottom end of each of said posts;

a first timber extending horizontally between and through each of said posts near the top ends of said posts; and a second timber having first and second ends, the second timber being disposed horizontally across the tops of said posts, the first and second ends extending outward from said posts, the first and second ends being swept skyward;

wherein said mounting pegs are inserted into the apertures defined in said top step in order to retain the ornamental fixture in an upright position.

4. The catering display according to claim 1, wherein said ornamental fixture comprises:

a fixture base, the fixture base being a planar, elongated, rectangular strip of a rigid material, the fixture base having top and bottom sides;

a pair of mounting pegs extending from said bottom side; and at least one ornamental figure mounted on said top side;

wherein said mounting pegs are inserted into the apertures defined in said top step in order to retain the ornamental fixture in an upright position.

5. The catering display according to claim 1, wherein said at least one tray comprises a plurality of trays.

* * * * *